US011235218B2

(12) United States Patent
Wiggins

(10) Patent No.: US 11,235,218 B2
(45) Date of Patent: Feb. 1, 2022

(54) GOLF SWING TRAINING APPARATUS

(71) Applicant: Brian Wiggins, Burlington, KY (US)

(72) Inventor: Brian Wiggins, Burlington, KY (US)

( * ) Notice: Subject to any disclaimer, the term of this patent is extended or adjusted under 35 U.S.C. 154(b) by 0 days.

(21) Appl. No.: 16/706,599

(22) Filed: Dec. 6, 2019

(65) Prior Publication Data

US 2020/0238145 A1 Jul. 30, 2020

Related U.S. Application Data

(60) Provisional application No. 62/776,148, filed on Dec. 6, 2018.

(51) Int. Cl.
*A63B 69/00* (2006.01)
*A63B 69/36* (2006.01)

(52) U.S. Cl.
CPC ..... *A63B 69/0059* (2013.01); *A63B 69/3667* (2013.01); *A63B 2225/093* (2013.01)

(58) Field of Classification Search
CPC ..... A63B 69/0059; A63B 69/3667; A63B 2225/093
See application file for complete search history.

(56) References Cited

U.S. PATENT DOCUMENTS 1,530,519 A * 3/1925 Remington ..... A63B 69/0059 473/216
2,611,610 A 9/1952 Rikuo
3,415,524 A 12/1968 Vickers
3,591,185 A 7/1971 Murat
3,698,721 A * 10/1972 Stewart ..... A63B 69/3641 473/264
4,318,546 A * 3/1982 Chen ..... A63B 69/3608 473/216
4,326,718 A 4/1982 Kiehl
4,593,909 A 6/1986 Anselmo
4,758,000 A 7/1988 Cox
4,815,743 A 3/1989 Meeker
5,050,885 A 9/1991 Ballard et al.
5,125,663 A 6/1992 Lurowist
6,551,196 B1 4/2003 Kossnar et al.
6,575,844 B1 6/2003 Gray
6,805,641 B2 10/2004 Pope
6,843,730 B1 * 1/2005 Bellagamba ..... A63B 69/0057 473/207
8,007,421 B2 8/2011 Goel et al.
8,277,331 B2 * 10/2012 Whitt ..... A63B 69/0057 473/266
8,852,014 B1 10/2014 Hoang
9,561,421 B2 2/2017 Hungelmann
2012/0322585 A1 12/2012 Petkov et al.

* cited by examiner

*Primary Examiner* — Nini F Legesse
(74) *Attorney, Agent, or Firm* — Carrithers Law Office, PLLC; David W. Carrithers

(57) ABSTRACT

A golf swing machine with movable guides that rest on the back of the neck/shoulders and against the lower back just above the belt to help guide a golfer into forming a proper swing. Two semi-circular guides rotate around the center of the spine forcing the user to rotate around his or her spine maintaining a proper spine angle during the swing. These guides are rotatably connected to a frame which is part of a stand on which the user stands. Smooth rotation of the guides up to 180 degrees without binding is enabled by guides connected to the device by rollers rolling in semi-circular channels.

1 Claim, 9 Drawing Sheets

GOLF SWING TRAINING APPARATUS

CROSS REFERENCES TO RELATED APPLICATIONS

This application claims priority from U.S. Provisional Application Ser. No. 62/776,148 filed on Dec. 6, 2018 and is hereby incorporated by reference herein in its entirety.

TECHNICAL FIELD

The present invention relates to the field of golf swing training devices used to help train a golfer to develop a proper swing.

BACKGROUND OF THE INVENTION

Individual golfers spend vast amounts of time and money to learn and improve their games. Even so, most golfers are substantially less skilled compared to professionals in the sport. Therefore, many of them will continue to spend time and money to improve their skills. Even the better golfers work hard and spend money to improve their skills and continue to search for that elusive perfect swing.

Most golf courses employ golf pro's or professionals who help teach and improve other's skills. Many tools and training devices have been developed and sold which are designed to help players improve their games.

There are numerous references which aid in training a golfer on how to swing the golf club correctly. U.S. Pat. No. 9,561,421 for SPORTS TRAINING AND CONDITIONING APPARATUS RELATING TO GOLF by Hungelmann which issued on Feb. 7, 2017 teaches a golf trainer which embraces the user's shoulders and hips and guides the user in a twisting or circular motion about a coaxial member. U.S. Pat. No. 4,758,000 for GAMES STROKE PRACTICING APPARATUS by Cox which issued on Jul. 19, 1988 teaches a golf trainer which embraces the user's shoulders and head and guides the user in a circular manner about a central axis. U.S. Pat. No. 2,611,610 for MECHANICAL GOLF PLAYER'S STANCE POSITIONED by Hara which issued on Sep. 23, 1952 teaches a golf trainer which embraces the user's hips, shoulders, and head with braces, belts and bands to force the user to move in a somewhat circular direction.

SUMMARY OF THE INVENTION

The golf swing training apparatus is adjustable and must be adjusted to the particular user. With the golf swing training apparatus properly adjusted, the golfer should practice the swing to become familiar with a proper swing. When a golfer has played a round or two and has detected a swing problem, the golfer can step into the golf swing training apparatus, swing a few times and regain the feel of a proper swing. The head should be kept perpendicular to the shoulder and the hips should be moved forward first, then the body and arms. It is contemplated that the base can include casters or wheels for movement.

The present invention provides a golf swing training apparatus that rests on the back portion of the neck and shoulders of the user as well as the back portion of the hips above the belt. The golf swing apparatus includes semi-circular elements which rotate around a reference point positioned with respect to the center of the user's spine. The apparatus is includes a base for the user to stand upon and has a frame abusable for height, length of torso, spine and angle tilt, and shoulder and hip thickness. The device requires the user to rotate their body with respect to their spine while maintaining the proper angle of the spine during left/right rotation and inward/outward movement of the spine during the golf swing. The shoulder position has a cam that pushes forward while rotating to keep the persons head level during rotation of the body through the swing. The shoulder has about 170 degrees of rotation and the hip has about 110 degrees of rotation allowing rotation without binding due to use of the carrier and roller bearing assembly.

The present invention provides a golf swing training apparatus with movable guides that contact the back of the neck/shoulders resting against the lower back just above the belt to help guide a golfer for developing a proper swing. Two spaced apart semi-circular guides are mounted to a longitudinal support member extending from a base. The support members are rotate around the center of the spine forcing the user to rotate around his or her spine maintaining a proper spine angle during the swing. These guides are rotatably connected to a frame which is part of a stand on which the user stands. Smooth rotation of the guides up to 180 degrees without binding is enabled by guides connected to the device by rollers rolling in semi-circular channels. Additionally, the shoulder guide has a cam that pushes the guide downward and outward while rotating to keep the person's head approximately perpendicular to the shoulders thru rotation. The device rests on the back of the neck/shoulders and the back of the hips above the belt. The half circle parts rotate around the center of the persons spine forcing them to rotate around their spine keeping their spine angle both left to right and in and out. These parts are connected to a stand which the person stands on and has adjustment for height, length of torso and spine angle/tilt. There is also adjustment for shoulder and hip thickness. The shoulder has about 170-180 degrees of rotation and the hip has about 110 degrees of rotation. What allows for this much rotation with out binding is the carrier part and the use of roller bearings. The shoulder position has a cam that pushes forward while rotating to keep the persons head level thru rotation.

In accordance with the present invention, there is provided a golf swing aid comprising, consisting of, or consisting essentially of a base plate with a vertical longitudinal post fixedly attached to a rear edge thereof wherein the post extends upward about four feet. A first bracket has a vertical aperture. The vertical post passes through and is adjustably held within said first aperture of the first bracket by a threaded member pressing against the vertical post and tightened by a first knob. The first bracket has a second bracket rotatably connected. The second bracket has a second aperture. A longitudinal neck guide holding member passes through the second aperture and is slidably adjustable within the second aperture. The neck guide holding member is held in place by a second threaded member tightened by a second knob. The second bracket rotates in a vertical plane providing vertical angular positioning of the longitudinal neck guide holding member. The second threaded member provides vertical sliding height adjustment of the longitudinal neck guide member. The longitudinal neck guide member extends upward and outward over the base member in a forward direction.

A forward facing third bracket connected to the second bracket has a top surface canted downward at about ten degrees below horizontal. The third bracket has two threaded apertures about one inch apart and equidistance from the forward end of the third bracket. A first disc has a first arcuate slot and is slidably and rotatably held to the top surface of the third bracket by a first pair of shoulder screws which pass through a flat washer and a flat roller. The rollers are captured in the first arcuate slot. The first disc is positioned so that the center of a circle defining an arc of the first arcuate slot is forward. The arcuate slot sweeps an angle of about 55 degrees. The first disc has two vertical threaded apertures, one near each end of the first arcuate slot. A second disc has a second arcuate slot which sweeps an angle of about 95 degrees. The second disc slides over top of the first disc and is slidably and rotatably held to the top surface of the first disc by a second pair of shoulder screws each of which pass through a flat washer and a flat roller. The rollers are captured in the second arcuate slot.

The second disc is positioned so that the center of a circle defining an arc of the second arcuate slot is forward. A back guide is adjustably held to the top surface of the second disc by threaded knobs. The back guide extends forward from the front of the second disc. A rectangular block is rigidly attached to the top end of the longitudinal neck guide holding member with the rectangular block extending forward and downward. The rectangular block is perpendicular to the longitudinal neck guide holding member and has a lengthwise slot. A disc holding member slides forward and back within the slot.

A spring contained therein urges the disc holding member backward. The distal end of the disc holding member has two threaded apertures formed therein near the distal end. A third disc having a third arcuate slot is slidably and rotatably held to the bottom surface of the disc holding member by a third pair of shoulder screws. Each of the third pair of shoulder screws passes through a flat washer and a flat roller. The rollers are captured in the third arcuate slot. The third disc is positioned so that the center of a circle defining an arc of the third arcuate slot is forward and the third arcuate slot sweeps an angle of about 55 degrees. The third disc has two vertical threaded apertures, one near each end of the third arcuate slot. A fourth disc has a fourth arcuate slot which sweeps an angle of about 140 degrees and slides over the bottom surface of the third disc. The fourth disc is slidably and rotatably held to the bottom surface of the third disc by a fourth pair of shoulder screws, each of which passes through a flat washer and a flat roller. The rollers are captured in the fourth arcuate slot. The fourth disc is positioned so that the center of a circle defining an arc of the second arcuate slot is forward. The fourth disc sweeps an angle of about 180 degrees with respect to the disc holding member.

The rectangular block has a downward extending lug on the front lower edge thereof. The outer edge of the fourth disc provides a cam surface sliding against the lug, the cam surface has a circular profile from the left end to a point 90 degrees counterclockwise with a radius of the circular profile being about four inches. The profile of the cam from 90 degrees counterclockwise to 180 degrees has a uniformly increasing radius from about four inches to about five and one quarter inches. The fourth disc has two longitudinal members 60 and 62 are connected to the slotted shoulder guide brackets extending downward and back, each with an elongated rearward extending slot. Each of the elongated slots has a downward extending longitudinal shaft fastened therein. The longitudinal shafts are perpendicular to the fourth disc, about eleven inches long, and are adjustable along the elongated slots.

It is an object of this invention to provide a golf swing aid which will help golfers to improve their swing.

It is an object of this invention to provide a golf swing aid which rests against a golfer's shoulder, neck and lower back and helps the golfer start the swing in the proper stance.

It is an object of this invention to provide a golf swing aid which rests against a golfer's shoulder or neck and lower back and remains in contact with those places during the entire golf swing giving the golfer feedback as to when he or she is leaving the proper swing path.

It is an object of the present invention to provide a golf swing training assembly that can be used to check your swing from day to day and detect whether your swing is deviating from a preferred position.

It is an object of the present invention to rotation of the hips first, then the body, and then the arms and to keep the head perpendicular to the shoulder.

It is an object of the present invention to promote rotation of the hips up to about 110 degrees and rotation of the should up to about 180 degrees.70

It is an object of this invention to provide a golf swing aid which can be adjusted and set to a particular golfer's best swing, so that anytime later, the golfer can use the golf swing aid to monitor the swing and correct any new changes or problems that have arisen while playing.

Other objects, features, and advantages of the invention will be apparent with the following detailed description taken in conjunction with the accompanying drawings showing a preferred embodiment of the invention.

BRIEF DESCRIPTION OF THE DRAWINGS

A better understanding of the present invention will be had upon reference to the following description in conjunction with the accompanying drawings in which like numerals refer to like parts throughout the views wherein.

DESCRIPTION OF THE PREFERRED EMBODIMENTS

Figure 1:
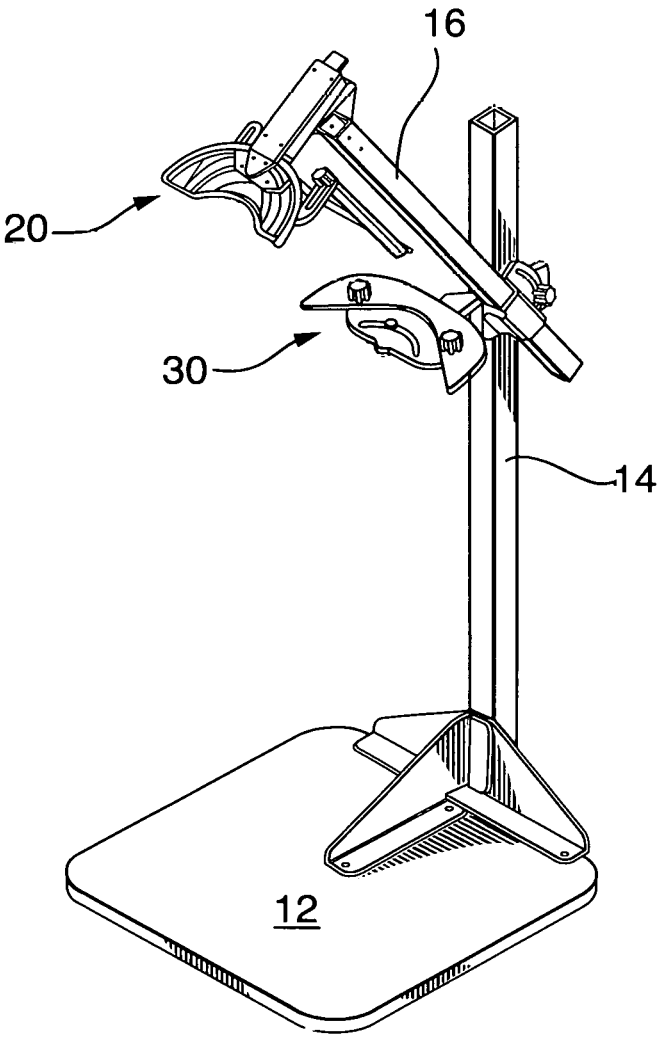
FIG. 1 is a perspective view of the golf swing training device.
Figure 2:
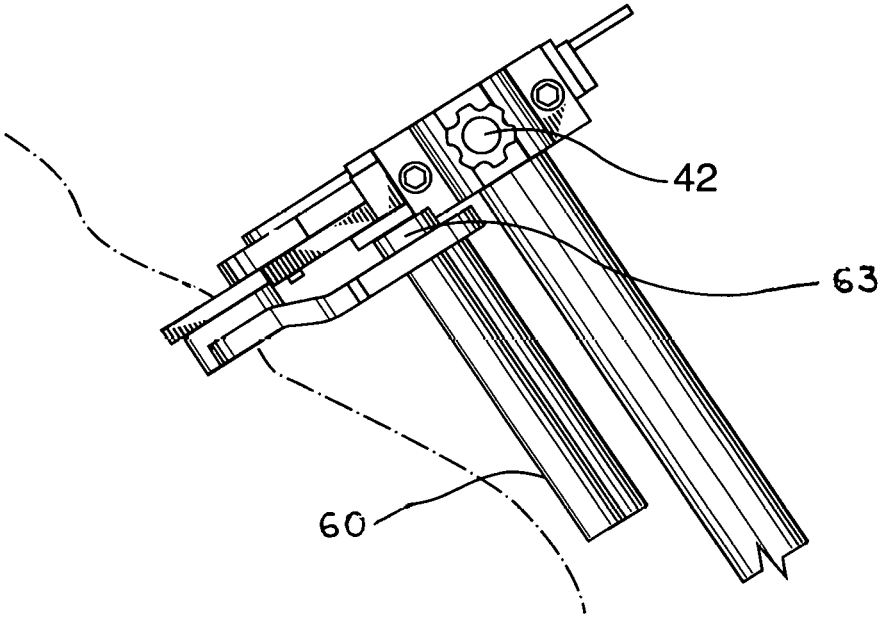
FIG. 2 is a left side view of the neck/shoulder guide.
Figure 3:
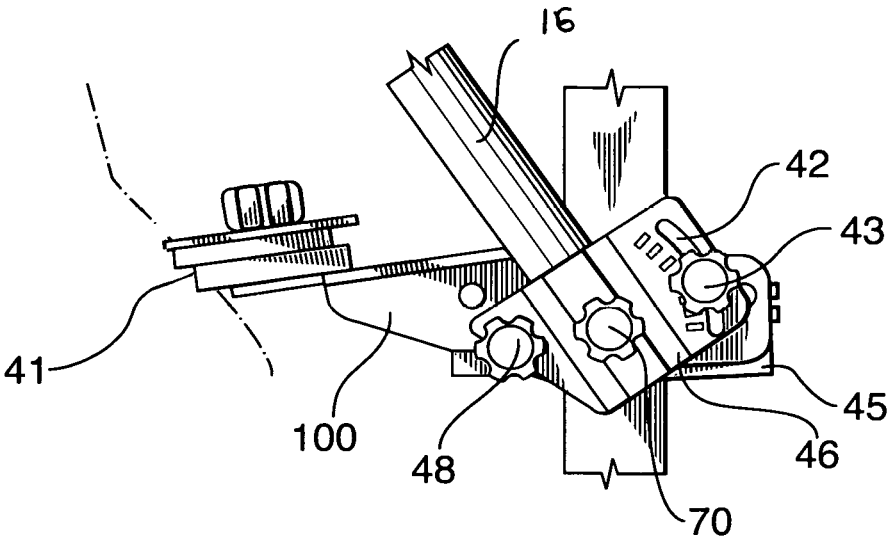
FIG. 3 is a left side view of the back guide.
Figure 4:
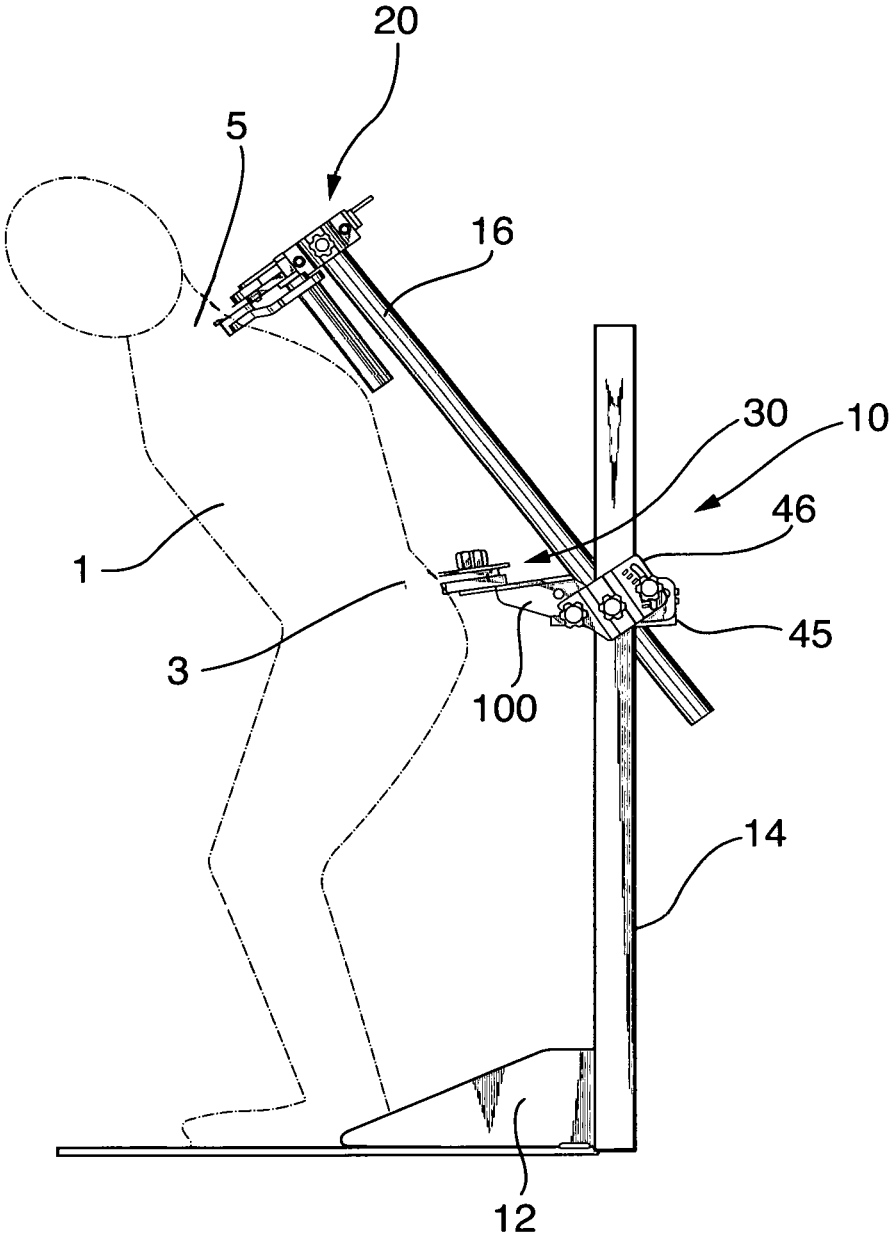
FIG. 4 is a left side perspective view of the golf swing training apparatus including an outline of a golfer showing positioning of the neck, shoulder, and back guides.
Figure 5:
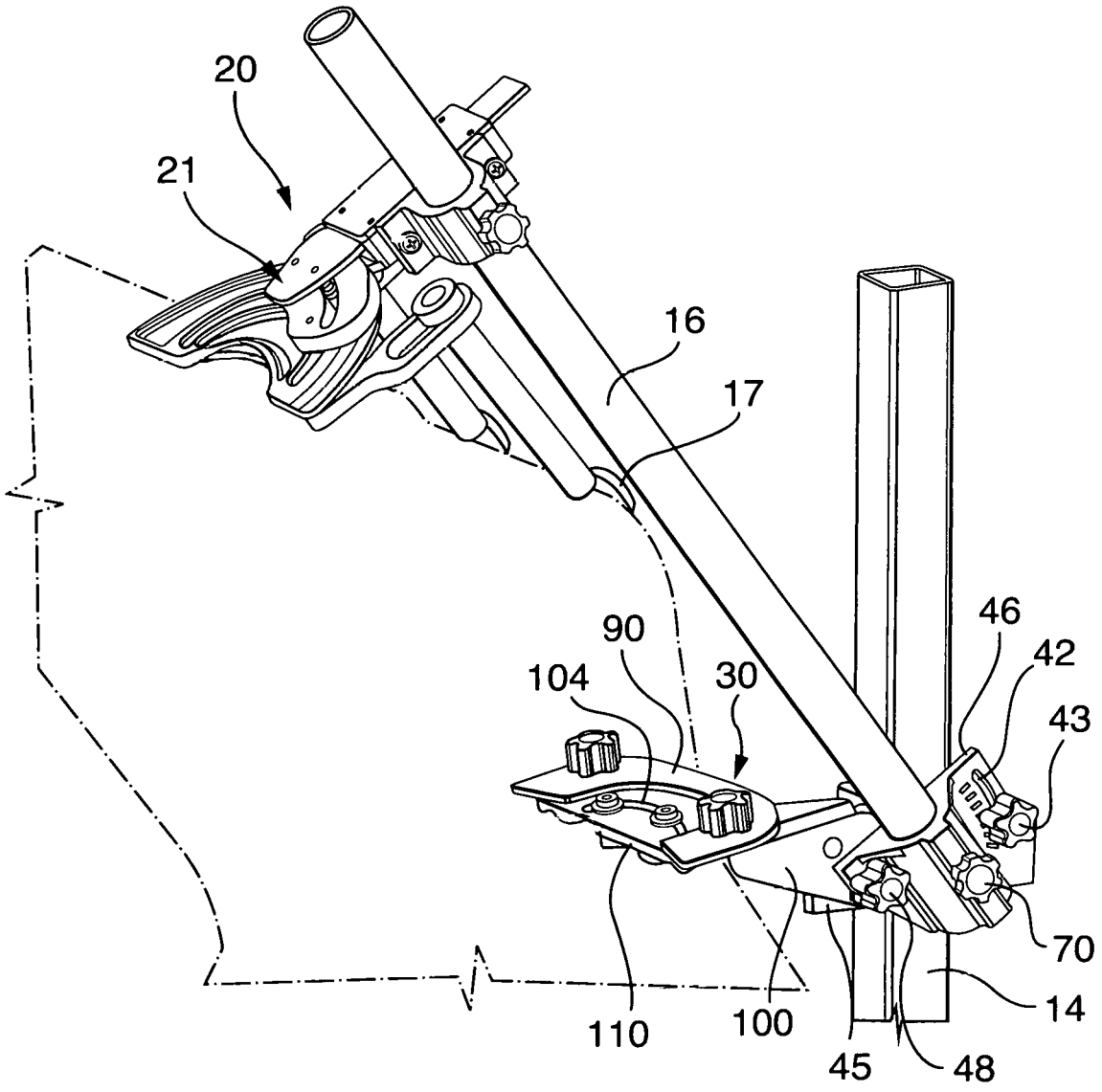
FIG. 5 is an enlarged view of the neck guide assembly and back guide assembly.
Figure 6:
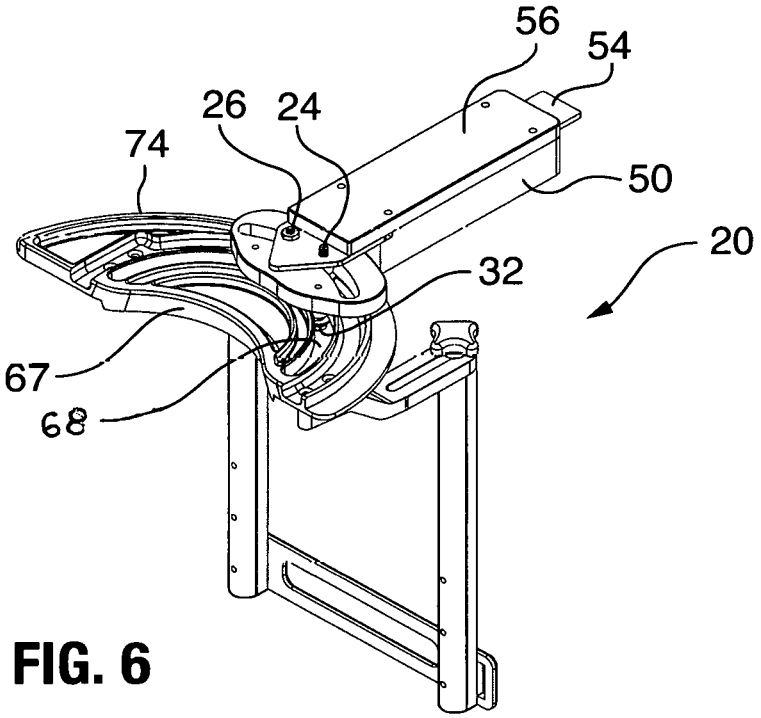
FIG. 6 is a perspective view showing the longitudinal members extending downward from the neck guide assembly for contacting the lower shoulder blade area of the golfer.
Figure 7:
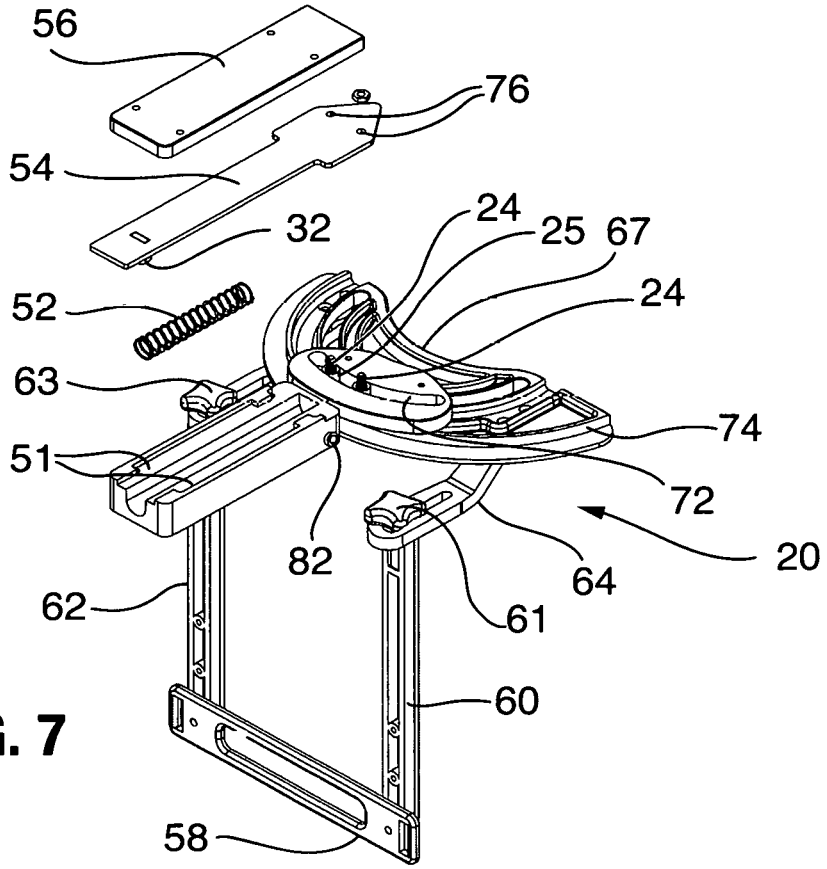
FIG. 7 is an exploded perspective view of the neck/shoulder guide assembly.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the Figures. As used herein, the term "about" can be reasonably appreciated by a person skilled in the art to denote somewhat above or somewhat below the stated numerical value, to within a range of ±10%.

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

As shown in the figures, there is provided a golf swing training apparatus 10 shown in the figures having points of contact with a golfer's neck/shoulders and the back just above the belt line during an entire swing to provide tactile feedback at the golfer's neck, lower shoulders and lower back, thus providing correct body position information from the back swing all the way through the follow-through. During the swing, a golfer's lower spine 3 rotates or pivots about the center of the circle radiating from the spine.

As shown in the figures, there is provided a golf swing training apparatus 10 shown in the figures having points of contact with a golfer's neck/shoulders and the back just above the belt line during an entire swing to provide tactile feedback at the golfer's neck, lower shoulders and lower back, thus providing correct body position information from the back swing all the way through the follow-through. During the swing, a golfer's lower spine rotates or pivots about the center of the circle radiating from the spine.

The parts of the golf aid that are in contact with the golfer are movable and necessarily move with the golfer during the swing. If the golfer's neck, shoulders or lower back lose contact with the golf aid at any time during the swing, then the swing is incorrect and the golfer can use this tactile feedback to know where correction is needed. The golf swing training apparatus 10 is intended to be in contact with the golfer's neck, the shoulders and the lower back just above the belt. More particularly, the lower back guide assembly contacts a portion of the body of the user's back just above a user's belt having up to about 10 degrees of tilt.

The golf swing training apparatus 10 is supported on the ground by a base plate 12. A vertical longitudinal post 14 is fixedly attached to the rear edge of the base plate 12 and extends upward a selected height of about four to six feet. The vertical post 14 slidably supports a vertically adjustable first back bracket 45 having a housing which includes an aperture cooperatively slidably engaging the vertical post 14 and is held firmly in place by an adjustable threaded member such as a bolt having a knob head which is threadably received within the housing of the bracket 45 and tightens against the post. The height of the bracket 45 is adjustable.

Connected to the front facing side of the bracket 45 is the back guide 30, which is attached to the top surface of the back guide bracket 100. The back guide bracket 100 is attached to the bracket 45 tilting downward about ten "10" degrees below the horizon. The back guide bracket 100 extends forward past the first bracket 45 and the vertical post 14. An adjustable threaded member such as a bolt having a knob head 48 is threadably received within a threaded aperture formed in the bracket 46 and bracket 100 to removably secure bracket 100 and a lower back guide assembly 30 supported thereby.

A longitudinal neck guide support member comprising an arm 16 passes through an aperture in a second neck bracket 46 having a housing with a threaded bolt and knob assembly 70 with the threaded bolt biased against the arm 16 providing a slidable adjustable means for which is rotatably connected to the bracket 45. The angle which the neck guide holding member or arm 16 makes with the post 14 is adjustable and adjusted with the threaded bolt and knob assembly 43 which is slidably received in an arcuate groove or slot 42 formed in a vertical plated formed in the rear portion of the bracket 45. The bolt and knob 43 extending through the slot 42 is tightened by cooperative engagement with a threaded aperture in the adjacent bracket 45. Tightening the knob 43 biases and holds the neck guide holding arm 16 at a selected angle.

The back guide assembly 30 is attached to the top surface of the back guide bracket 100. The back guide bracket 100 is fixedly attached to the first bracket 45 and extends forward past the first bracket 45 past the vertical post 14. The back guide bracket 100 is attached to the bracket 45 tilting downward about ten degrees below the horizon. Near the forward end of the back guide bracket are two threaded apertures 118 about one inch apart and equidistance from the forward end of the bracket 100.

A first back disc 110 with an arcuate slot 111 is held to the top surface of the bracket 100 by two shoulder screws 116, each passing through a flat washer 114 and then a flat roller 112. The rollers are captured in the arcuate slot 111 in the first back disc 110. The first back disc. forward facing arcuate slot 111 is positioned so that the center of the circle which defines the arc is in front of the back guide 30 and the arcuate slot sweeps an angle of about 55 degrees. The first back disc 110 contains two vertical threaded apertures 109 near the ends of the fifty-five degree arcuate slot on the inside of the arc defined by that slot. Thus, the disc is free to slide in an arc shaped path of about 40 degrees (limited by the rollers) while the rollers 112 roll in the arcuate slot. The back guide member 90 comprises a thin plate having an arcuate edge and is adjustably attached to the top surface of a rear portion of the first back disc 110 by threaded bolts extending from knobs which extend through short forward facing slots 93 and engage threaded apertures in the first back disc 110.

A second back disc 102 with a second back disc forward facing arcuate slot 104 includes a sweeping angle of about ninety-five degrees and slides over top of the first back disc 110. The second back disc 102 with an second back disc arcuate slot 104 is movably held to the top surface of the first disc 110 by two shoulder screws 106 threaded into the threaded apertures 109 in the first disc, each of the screws 106 passing through flat washers 107 and flat rollers 108. The rollers 108 are captured in the second back disc arcuate slot 104. The first back disc arcuate slot 111 and the second back disc arcuate slot 104 have the same center point about which they can move, as guided by the rollers 112 and 108.

The second back disc 102 can move in an arcuate path with respect to the first back disc 110 by and angle of about sixty degrees. The first back disc 110 can move in an arcuate path with respect to the back guide bracket 100 by an angle of about 50 degrees. Therefore, the second back disc 102 can move with respect to the back guide bracket in an arcuate path by a combined angle of about 110 degrees.

The back guide member 90 is adjustably held to the top surface of the second back disc 110 by threaded bolt members having knobs attaching to threaded bolts 94 and 95 and extending through a forward facing arcuate slot 104 fastening in the top surface of the second back disc 102 forward of the arcuate slot 140 formed in the first back disc 110. When the back of the golfer remains in contact with the back guide, the guide gives the golfer's lower back about 110 degrees freedom of movement. The golfer's spine will be located approximately in the center of a circle which defines the arc made by the movement of the first back disc 110. Thus, the golfer's spine should remain at and rotate around the center of this circle. Thus, the back guide 30 guides the rotation of the golfer's back. Because the back guide bracket 30 tilts downward by about ten degrees, the golfer's back is tilted by about the same angle in alignment with the hips and shoulder during the swing.

The neck guide assembly 20 rests on the golfer's neck and back and pivots with respect to the back guard assembly 30 thus allowing the back guide 90 to pivot around with the golfer's back. Likewise, the back of the golfer's neck encounters the arcuate neck guide portion 22 of the third neck disc or plate which also pivots on the neck guide assembly 20 during the swing.

The neck guide assembly 20 is fixedly connected to the neck guide arm 16. The height of the neck guide assembly 20 is adjustable and should be adjusted so that the arcuate neck guide portion 22 touches near the bottom of the user's neck. Further, the shoulder guides 60 and 62 can be adjusted by loosening the knobs 61 and 63 on the neck guide assembly and moving the shoulder guides until they contact the shoulders of the user.

The neck guide assembly 20 defines an arcuate edge portion on the front portion of a third bottom neck disc 74 and remains in contact with the back of the golfer's neck through the entire swing. The golfer's upper spine 5 also remains at the center of movement of the neck guide assembly 20 during that swing. However, the golfer's head and neck move downward during the back swing, as will be noted later. Therefore, the neck guide assembly 20 includes a cam device 21 which causes the neck guide 90 to move downward as the golfer makes the back swing portion of the swing. Further, as the golfer performs the down swing, the neck guide assembly 20 raises back to the starting height as the guide rotates back.

Figure 8:
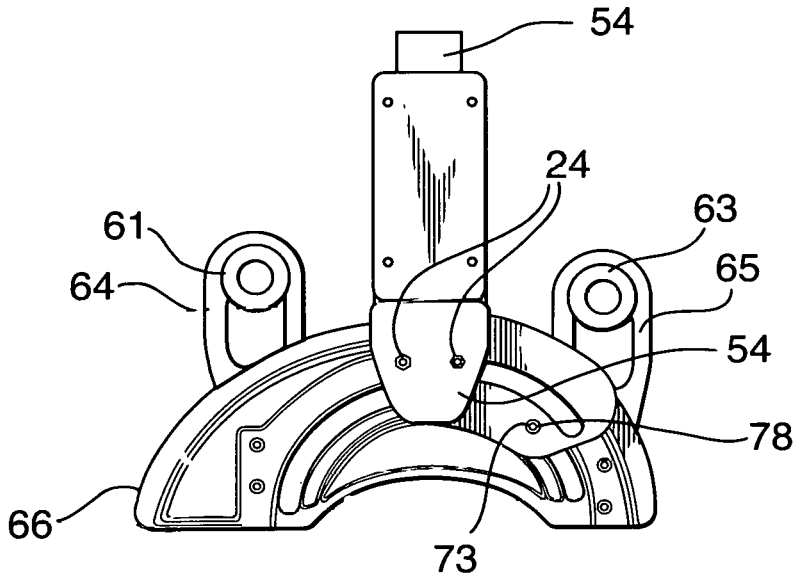
FIG. 8 is a perspective top view of the neck guide assembly.
Figure 9:
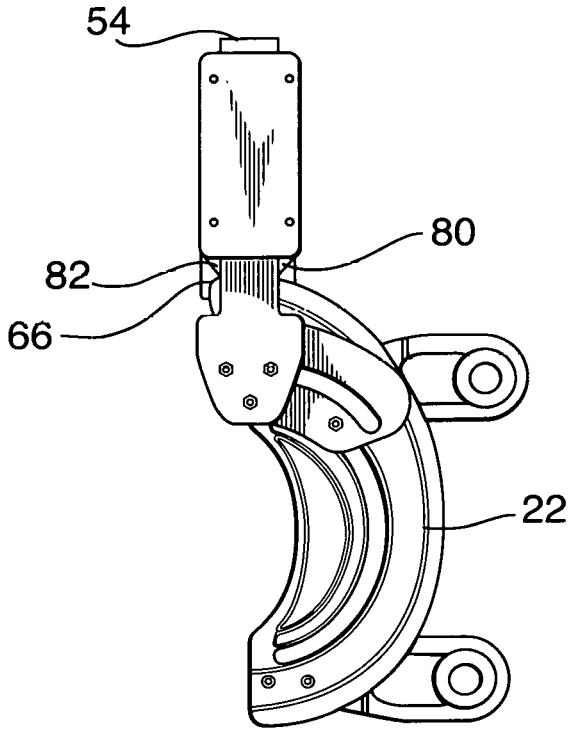
FIG. 9 is a top view of the neck guide assembly of FIG. 8 rotated about 90 degrees.
Figure 10:
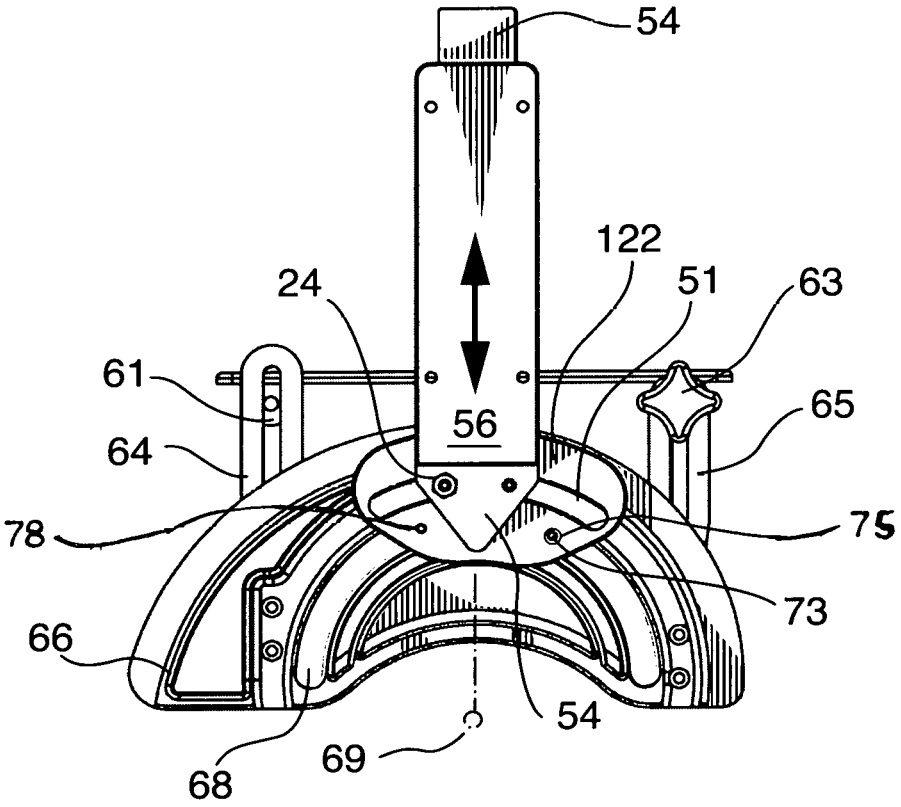
FIG. 10 is a perspective top view of the neck guide assembly including the shoulder guide members of FIG. 7.
Figure 11:
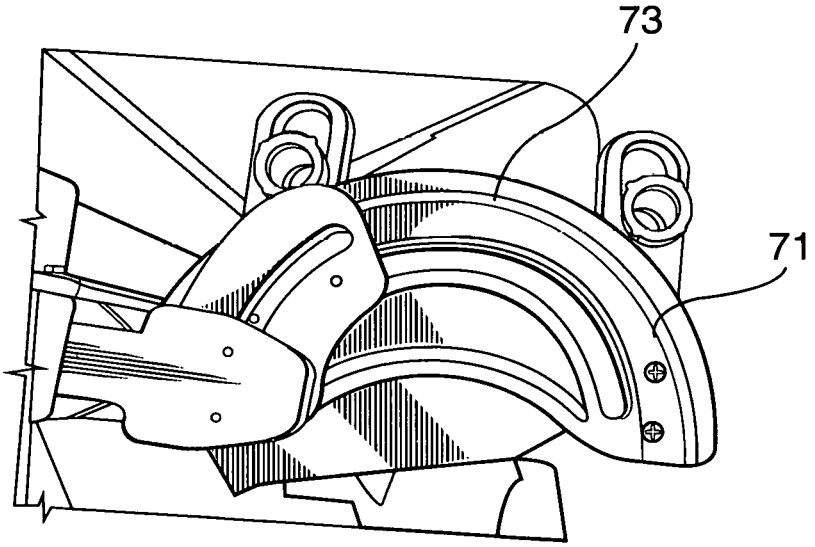
FIG. 11 is a top view of the neck guide assembly showing third neck disc and the arcuate slot and guide rim positioned with respect to the fourth neck disc and the head rotated about 90 degrees.
Figure 12:
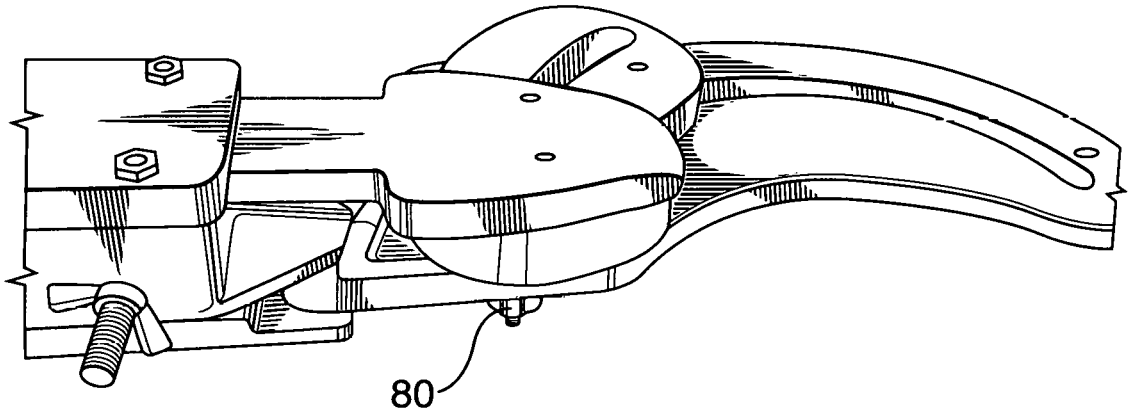
FIG. 12 is a side view of FIG. 12 showing the neck guide assembly showing third neck disc and the arcuate slot and guide rim positioned with respect to the fourth neck disc and the head rotated about 90 degrees.
Figure 13:
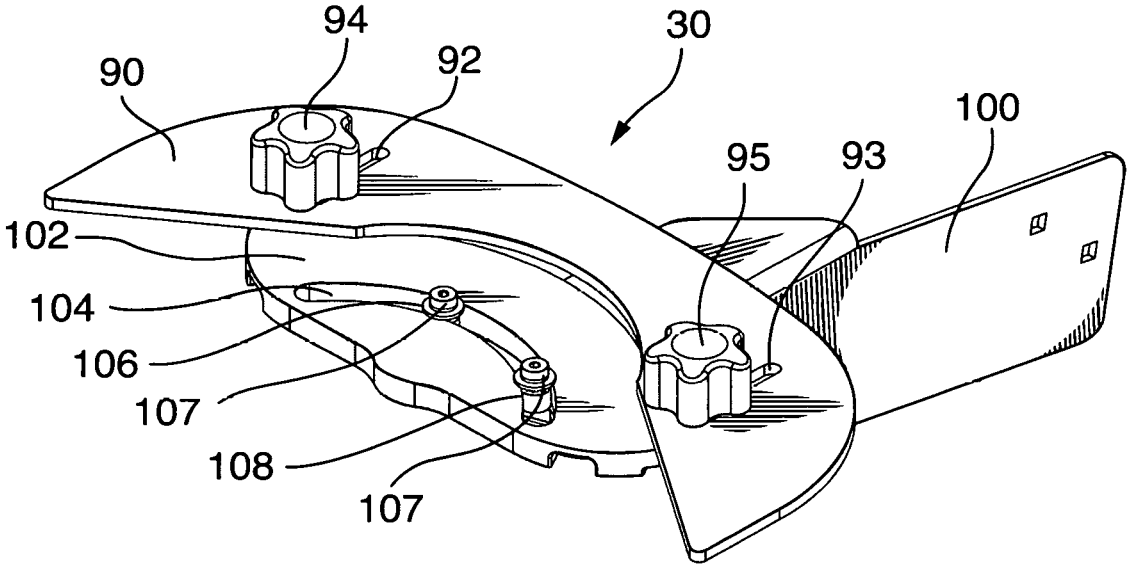
FIG. 13 is a perspective view of the neck guide assembly and back guide assembly.
Figure 14:
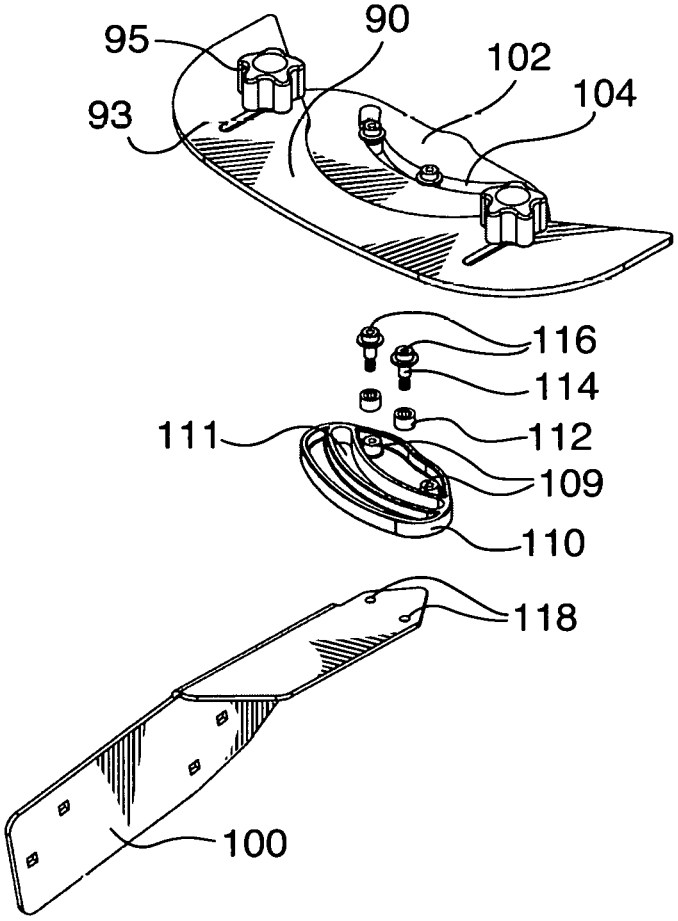
FIG. 14 is a perspective exploded view of the back guide assembly.

The back of the neck 40 of the golfer is intended to contact the valley 67 in the neck guide portion of the third disc 74. In this way, the center of the golfer's spine is in the center point 69 of the circle as shown in FIG. 8 which defines the semicircular path of semicircular third neck disc 74. Extending downward from the semicircular disc 74 are two longitudinal members or rods 60 and 62. The two longitudinal shoulder members 60 and 62 extend downward from a pair of slotted shoulder guide brackets attached to a bottom surface of the third neck disc of the neck guide assembly to contact the lower shoulder blade area of the golfer. The lower ends of the members 60 and 62 are connected to one another by a cross piece 58. The lower ends of the members 60 and 62 are intended to touch the back of the golfer's shoulders during the swing. The two longitudinal members 60 and 62 are connected to the slotted shoulder guide brackets 64 and 65 extending downward and back from the neck guide portion 20 by threaded knobs 61 and 63. The slots in the shoulder guide brackets 64 and 65 extend rearward from the neck guide portion 20. A strap 17 may be attached to the shoulder members 60 and 62 for securing the user to the shoulder members and limiting movement therebetween. Because the neck guide assembly 20 and back guide assembly 30 are fixedly attached to the golf swing training apparatus base 12 on which the golfer stands, the movements of the golfer are restricted and guided by the neck guide and back guide. It is anticipated that the golf swing training apparatus can be utilized without a cross member 64 whereby the shoulder members 62 are affixed to the third neck disc by attachment means and only the ends of the longitudinal members 60 and 62 contact the golfer's shoulder.

The back of the golfer's neck should remain in contact with the outer forward arcuate portion 67 of the third neck disc 74 of the neck guide portion during the full swing of a golf club and that the golfer's shoulders remain in contact with the bottom of the shoulder guides 60 and 62 during the full swing.

A freedom of angular movement of about 180 degrees utilizing a cam device 21 including flat rectangular slidable elongated disc holding member 54 having an enlarged angular arrow shaped head 55 whereby the proximate side edges of the head forming stop means is slidably held between a flat elongated rectangular top plate 56 spaced apart from and an elongated rectangular block 50. The sliding disc holding member 54 slides back and forth with respect to rotation of the third neck disc in order to accommodate the upward and downward motion of the user's neck during a swing. The block 50 is rigidly attached at the proximal end to the top end of the longitudinal neck guide holding member 16 at a right angle such that the block 50 points forward and downward.

The disc holding member 54 has two threaded apertures the distal end forming the head 55. Two threaded members such as screws or bolts pass through two flat washers and two rollers 25, 26 and the screws 24 and rollers 25 pass upward through an arcuate slot 72 in the third disc 74 and slidably fastened into the threaded apertures 76 so that the third disc 74 is held under the distal end of the disc holding member 54.

There are two threaded apertures 78 extending upward through the third disc 74, one near each end of the arcuate slot 72. The arcuate slot 72 sweeps an angle of about 90 degrees. Two more screws 73 pass through flat washers and rollers 75 and an arcuate slot 68 in a fourth disc or plate 122, also referred to as the neck guide and are threaded into the threaded apertures 73 in the third disc 74. The arcuate slot 68 sweeps an angle of about 180 degrees.

With reference to the figures, it can be noted that the third neck disc 74 is not symmetrical. There is a cam surface 66 that follows the outer edge of the third neck disc 74. A lug 82 on the bottom distal edge of the block 50 contacts the outer surface of the third neck disc 74 and cooperative engages a center notch 73 formed in an arcuate rim 71 extending around an outer guide groove 68. A disc holding member such as a projection or stud 80 extending downward from the outer distal end of the disc holding member 54 slides in a slot 51 within the fourth neck disc 122 disposed between the third neck disc and the disc holding member 54. The fourth disc 122 includes a pair of screws and rollers with a washer to extending therefrom in slidable engagement within an inner arcuate fourth disc groove formed in the third neck disc and held in position by pins or holding members extending through the grooves and affixed to the bottom surface of the fourth disc member 122. A parallel slot in block 50 contains a compression spring 52. The disc holding member 54 has a lug 32 extending down from the proximal end which contacts the proximal end of the spring 52 to urge the disc holding member 54 in the proximal direction.

The third disc 74 and a fourth disc 122 are situated on their respective rollers so that the center of a circle which defines the arcuate slots 72 and 68 is forward and downward from the distal end of the disc holding member 54. The fourth disc 122 can sweep an angle of about forty degrees with respect to the disc holding member 54. The third disc can sweep an angle of about 140 degrees with respect to the fourth disc 122. Thus, the fourth disc 122 can seep an angle of about 170 degrees with respect to the disc holding member 54.

The full range of angular motion for the lower back is 110 degrees. The angular motion is achieved with two discs rotatably attached to one another to provide part of this range, and one of these discs is rotatably attached to a fixed bracket on the stand. Because two rollers are used to provide rotation within an arcuate slot, the arcuate slot would have to sweep and angle of 150 degrees or so in order to provide 110 degrees of movement. This would cause the disc to extend past the back guide member 90 on each side. This would be undesirable because the golfer's back would be pushed too far from the disc. Therefore, the combination of two rotatable discs with rollers and arcuate slots provides the workable solution. The same situation applies with regard to the neck and shoulder guide assembly.

During a golf swing, the golfers head and neck naturally come down and forward at the maximum back swing. Therefore, the entire neck guide needs to move downward during the back swing.

The fourth disc 122 is turned counterclockwise during the back swing and the lug 82 moves against the cam face 74. Because the center point 69 of the arcuate neck portion 67 in the fourth disc 122 is urged downward, the neck and head of the golfer to allowed to move downward and forward. As the golfer swings the club forward, the reverse occurs and the neck and head rise back to a natural position.

The cam's maximum effective radius at point 66 on the cam is about five and one quarter inches. That is, the distance from center point 69 to cam point 66 is about five and one quarter inches. This maximum radius is in effect at the full pint of the golfer's back swing. The effective radius as the golfer swings and strikes the ball decreases gradually to about four inches. Because the cam surface 74 is always in contact with the lug 82, at full back swing, the cam surface pushes the neck guide assembly 20 downward five and one quarter inches, providing the normal movement of the golfer during back swing. The radius from the ball strike to the end of the forward swing remains at about four inches. From the time the golfer strikes the ball to the end of the forward swing, the neck and spine rotate but the spine remains centered within the neck guide assembly.

The foregoing detailed description is given primarily for clearness of understanding and no unnecessary limitations are to be understood therefrom, for modification will become obvious to those skilled in the art upon reading this disclosure and may be made without departing from the spirit of the invention and scope of the appended claims. Accordingly, this invention is not intended to be limited by the specific exemplification presented herein above. Rather, what is intended to be covered is within the spirit and scope of the appended claims.

I claim:

1. A golf swing training apparatus comprising:

a base plate with a vertical longitudinal post fixedly attached to a rear edge thereof, said vertical post adjustably held within a first aperture of a first bracket by a threaded member pressing against said vertical longitudinal post and tightened by a first knob, said first bracket having a second bracket rotatably connected thereto, said second bracket having a second aperture formed therein, a longitudinal neck guide holding member passing through said second aperture, said longitudinal neck guide member being slidably adjustable within said second aperture and held in place by a second threaded member tightened by a second knob, said second bracket rotating in a vertical plane providing vertical angular positioning of said longitudinal neck guide holding member, and said second threaded member providing vertical sliding height adjustment of said longitudinal neck guide member, said longitudinal neck guide member extending upward and outward over said base member in a forward direction;

a forward facing third bracket connected to said second bracket having a top surface canted downward at a selected top surface angle below horizontal, said third bracket having two threaded apertures formed therein spaced apart and equidistance from a forward end of said third bracket, a first disc having a first arcuate slot formed therein, said first disc slidably and rotatably held to said top surface of said third bracket by a first fastening means said first fastening means passing through a at least a first roller, said first one roller captured in said first arcuate slot, said first disc positioned with a center of a circle defining an arc when said first arcuate slot is in a forward position, said arcuate slot sweeping a selected angle, said first disc having means of attachment formed therein near each end of said first arcuate slot;

a second disc having a second arcuate slot formed therein, said second arcuate slot sweeping a selected angle, said second disc sliding over a top surface of said first disc, said second disc slidably and rotatably held to said top surface of said first disc by a second pair of fastening means, each of said second pair of fastening means passing through at least a second roller, said second roller captured in said second arcuate slot, said second disc positioned with a center of a circle defining an arc when said second arcuate slot is in a forward position, a back guide is adjustably held to a top surface of said second disc by fastening means projecting forward from a front of said second disc;

a block is rigidly attached to a top end of said longitudinal neck guide holding member with said block extending forward and downward perpendicular to said longitudinal neck guide holding member, said block having a lengthwise slot formed therein, a disc holding member sliding forward and back within said lengthwise slot, a spring contained therein urging said disc holding member backward, a distal end of said disc holding member having at least one aperture formed therein near a distal end;

a third disc having a third arcuate slot slidably rotatably held to a bottom surface of said disc holding member by a third fastening means, each of said third means passing through at least a third roller, said third roller captured in said first arcuate slot, said third disc is positioned so that a center of a circle defining an arc of said third arcuate slot is in a forward position with said third arcuate slot sweeping a third selected angle, said third disc having at least one aperture formed therein near each end of said third arcuate slot;

a fourth disc having a fourth arcuate slot formed therein, said fourth slot sweeping a fourth selected angle and sliding over a bottom surface of said third disc, said fourth disc slidably and rotatably held to a bottom surface of said third disc by a fourth fastening means, each of said fourth fastening means passing through a at least a fourth roller, said fourth roller captured in said fourth arcuate slot, said fourth disc is positioned so that a center of a circle defining an arc of said second arcuate slot is in a forward position, said fourth disc sweeping an angle of up to 180 degrees with respect to said disc holding member;

said rectangular block including a parallel slot containing a compression spring in cooperative engagement with a lug extending downward from a slidable elongated disc holding member, said outer edge of said fourth disc providing a cam surface sliding against said lug, said cam surface having a circular profile from a left end to a point ninety degrees counterclockwise, a radius of said circular profile being about four inches, said profile of said cam from ninety degrees counterclockwise to 180 degrees having a uniformly increasing radius; and said fourth disc having two a pair of slotted shoulder guide brackets extending downward and back from said longitudinal neck guide holding member and having elongated rearward extending slots formed therein, each of said elongated slots having a downward extending longitudinal shafts fastened therein, said longitudinal shafts are perpendicular to said fourth disc and adjustable along said elongated slots.

* * * * *